US010544526B2

(12) United States Patent
Guleken

(10) Patent No.: US 10,544,526 B2
(45) Date of Patent: Jan. 28, 2020

(54) OBTAINING EMERIZED FABRIC PROPERTIES BY WITHOUT APPLYING SUEDING PROCESS TO WOVEN FABRIC WITH COTTON YARN

(71) Applicant: KIPAS MENSUCAT ISLETMELERI ANONIM SIRKETI, Kahramanmaras (TR)

(72) Inventor: Mustafa Guleken, Kahramanmaras (TR)

(73) Assignee: KIPAS MENSUCAT ISLETMELERI ANONIM SIRKETI, Kahramanmaras (TR)

( * ) Notice: Subject to any disclaimer, the term of this patent is extended or adjusted under 35 U.S.C. 154(b) by 23 days.

(21) Appl. No.: 16/063,466

(22) PCT Filed: Dec. 28, 2016

(86) PCT No.: PCT/TR2016/050560

§ 371 (c)(1),
(2) Date: Jun. 18, 2018

(87) PCT Pub. No.: WO2017/116374

PCT Pub. Date: Jul. 6, 2017

(65) Prior Publication Data

US 2019/0003085 A1 Jan. 3, 2019

(30) Foreign Application Priority Data

Dec. 31, 2015 (TR) ..... 2015/17806

(51) Int. Cl.
*D03D 15/08* (2006.01)
*D03D 15/00* (2006.01)
*D03D 27/04* (2006.01)
*D03D 17/00* (2006.01)

(52) U.S. Cl.
CPC ..... *D03D 15/08* (2013.01); *D03D 15/0027* (2013.01); *D03D 27/04* (2013.01); *D10B 2201/02* (2013.01); *D10B 2331/10* (2013.01)

(58) Field of Classification Search
CPC ..... D03D 15/08; D03D 7/00; D03D 13/00; D03D 13/004; D03D 15/00; D03D 15/04; D03D 15/06; D03D 17/00; D03D 1/00; D03D 27/04; D03D 27/00; Y10T 442/3024; Y10T 442/3179; Y10T 442/3504
See application file for complete search history.

(56) References Cited

U.S. PATENT DOCUMENTS 4,677,011 A * 6/1987 Matsuda ..... A44B 18/0034 428/100
4,714,096 A * 12/1987 Guay ..... A44B 18/0034 139/391
5,680,826 A * 10/1997 Nagahama ..... A47L 23/266 112/410

(Continued)

*Primary Examiner* — Robert H Muromoto, Jr.
(74) *Attorney, Agent, or Firm* — Davidson, Davidson & Kappel, LLC

(57) ABSTRACT

A woven fabric is provided wherein pile weft yarns, auxiliary weft yarns, and warp yarns are weaved in the front face and back face of the fabric according to a pattern, and wherein at least one of the pile weft yarns and/or auxiliary pile yarns is synthetic elastomeric yarn and at least one of the same is cotton core-spun elastomeric yarn.

3 Claims, 5 Drawing Sheets

(56) References Cited

U.S. PATENT DOCUMENTS

Figure 1:
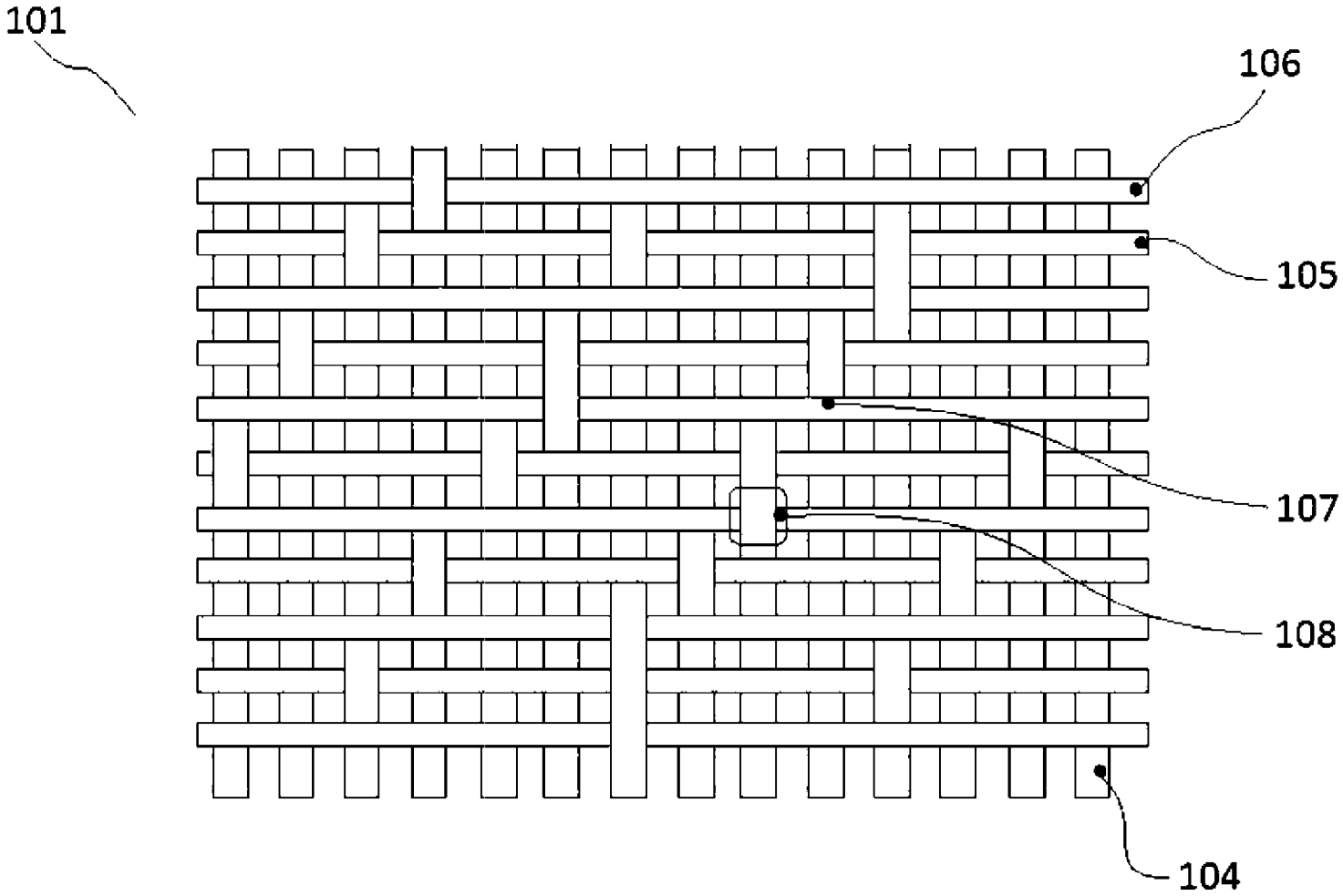

| | | | | |
|---|---|---|---|---|
| 7,827,829 | B2 * | 11/2010 | Fujikawa | A47C 31/006 66/195 |
| 2002/0088501 | A1 * | 7/2002 | Bruner | D02G 3/32 139/2 |
| 2003/0104161 | A1 * | 6/2003 | Edwards | A46B 3/04 428/85 |
| 2006/0207296 | A1 * | 9/2006 | Fujikawa | A47C 31/006 66/202 |
| 2013/0048140 | A1 * | 2/2013 | Yenici | D03D 15/04 139/422 |
| 2013/0287990 | A1 * | 10/2013 | Katagi | D01H 7/24 428/92 |
| 2015/0038042 | A1 * | 2/2015 | Erkus | D03D 13/004 442/203 |
| 2017/0065449 | A1 * | 3/2017 | Tsuchiya | A61F 5/0118 |
| 2017/0071773 | A1 * | 3/2017 | Tsuchiya | A61F 5/0106 |

* cited by examiner 106
105
106
105
106
105

OBTAINING EMERIZED FABRIC PROPERTIES BY WITHOUT APPLYING SUEDING PROCESS TO WOVEN FABRIC WITH COTTON YARN

FIELD OF THE INVENTION

The invention relates to obtaining a sueding-like effect on a woven fabric with cotton yarns.

The invention particularly relates to producing a woven fabric with firm handle and soft touch that has suitable dimensional stability by using cotton yarns having a high degree of hairiness according to the determined pattern and fabric design, without using any machine for the application of sueding process.

BACKGROUND OF THE INVENTION

In the state of the art, the sueding finish process is applied to the fabrics used in the manufacture of textile products such as wool fabrics, furnishing fabrics, blankets, overcoats, jackets, tracksuits, coats and the like, in order to provide them with firm handle and soft touch functions. With this process, soft and bulky fabrics with low thermal transmittance could be obtained. It is possible to provide the fabrics with a velvety, napped appearance as a result of sueding process. Today, different methods are employed for achieving woven fabrics with a suede-like effect. Different types of sueding machines (brush sueding machine) that apply sueding process, are used for sueding process on the woven fabric. It is not possible, without the use of these machines, to apply sueding process on the woven fabric.

The following properties are provided to the fabric using the sueding process.

- The thermal transmittance of the fabric changes: The fabric is provided with additional volume due to pullout of the fibers from the yarns forming the fabric. Since the expanded yarns will fill the pores of the fabric, air motion from the inside to the outside, or vice versa, is reduced. The fabric thus hacons a structure preserving the heat.
- The handle of the fabric changes: Owing to the contraction of the fabric, it is provided with a more firm structure. The thus obtained firm structure also increases the softness of the fabric handle.

Nowadays, various sueding machines are used so as to obtain the suede-like effect in the woven fabrics. Some patents in relation to sueding machines were found on patent search. The Utility Model Application Nos. CN203878358 (U), CN203639702 (U), CN202626641 (U), CN2503091 (Y), and the Patent Publication No. CN103321008 (A) all disclose sueding machines developed for subjecting the woven fabrics to sueding process in textile industry.

The Patent No. US2015275421 (A1) owned by the firm Alcantara Spa discloses a process for the preparation of a non-woven microfibrous suede-like synthetic fabric that does not require the use of organic solvents. However, this process is only applicable to non-woven surfaces, not to the woven fabrics formed of cotton yarns.

The Patent No. U.S. Pat. No. 4,712,281 discloses napping, pile loop forming of the fabric by subjecting the same to sueding process.

The method of the Patent No. U.S. Pat. No. 4,712,281 is also disadvantageous in that the suede-like effect is achieved by mechanical, physical processing by means of an individual process.

- Since it is an individual and independent process, it causes that initial investment, labor and energy costs are very high.
- In the known methods, since the fabric surface is subject to abrasion by mechanical processing, the strength of the fabric itself, and thus that of the yarns forming the fabric, decreases.
- Due to plucking a great amount of the fibers, the total weight of the fabric may decrease. Said weight loss, in turn, increases the costs.
- During sueding operation, the fiber ends in the yarn are pulled out and broken, which, subsequently, causes the so-called pilling error, i.e. the flakes on the fabric surface.
- During abrasion operation, on the other hand, the yarns which are broken or the lengths of which become shorter may break off the fabric later. Said cotton fibers having broken off the fabric may adhere to the surface of other fabrics, thereby causing unwanted problems.

As a result, the need for a method whereby emerized fabric properties are obtained without using any sueding machine or process in order to achieve a woven fabric with a soft touch and firm effect, as well as the inefficiency of the existing solutions, has deemed it necessary to make a development in the related technical field.

OBJECTS OF THE INVENTION

The present invention relates to obtaining a suede-like effect on a woven fabric with cotton yarns.

The primary object of the invention is to develop a woven fabric with a firm handle and soft touch that has suitable dimensional stability, using cotton yarns having a high degree of hairiness according to the determined pattern and fabric design, but without using any machine for the application of sueding process.

Another object of the invention is to reduce labor cost, costs of energy and cost of investment, thanks to eliminating the sueding process.

Another object of the invention is to reduce the pilling defect on the fabric surface due to the fact that the decreases in the fabric strength are prevented, as well as preventing the pullout and breaking of the fiber ends in the yarn, by eliminating the sueding process.

Another object of the invention is to overcome the financial losses resulting from the decrease in the total weight of the fabric due to plucking a great amount of the fibers from the fabric surface during the sueding process.

In addition to the advantages above, the duration of manufacturing is decreased since the duration of the process will also be decreased. Owing to the fewer number of steps, machine investment costs are reduced and less working space is needed.

The structural and characteristic features and all advantages of the invention will be understood more clearly by referring to the following drawings and the detailed description written with reference to these drawings. Therefore, while making an evaluation, these drawings and the detailed description should be taken into account together.

FIGURES FOR A BETTER UNDERSTANDING OF THE INVENTION

Figure 2:
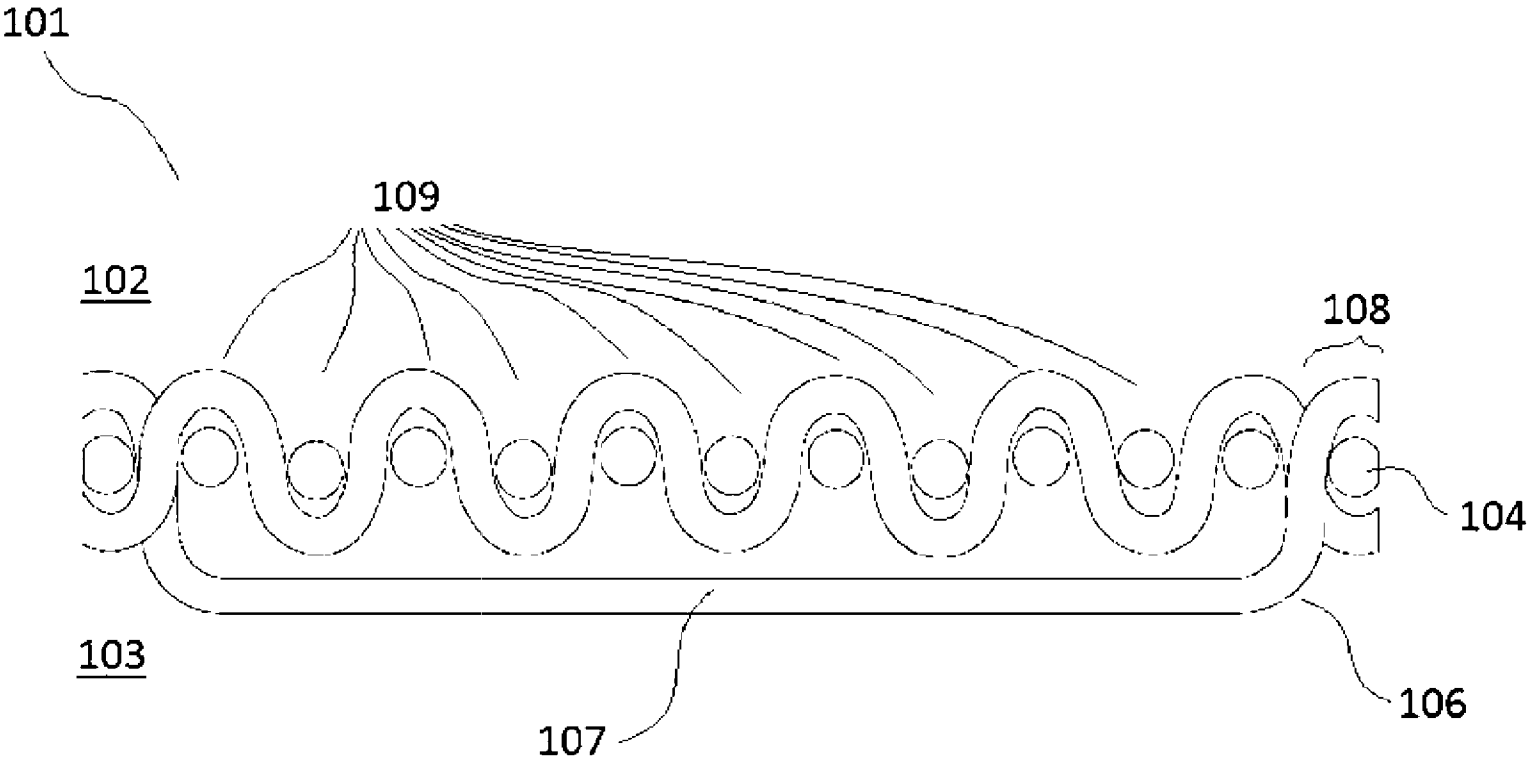
Figure 3:
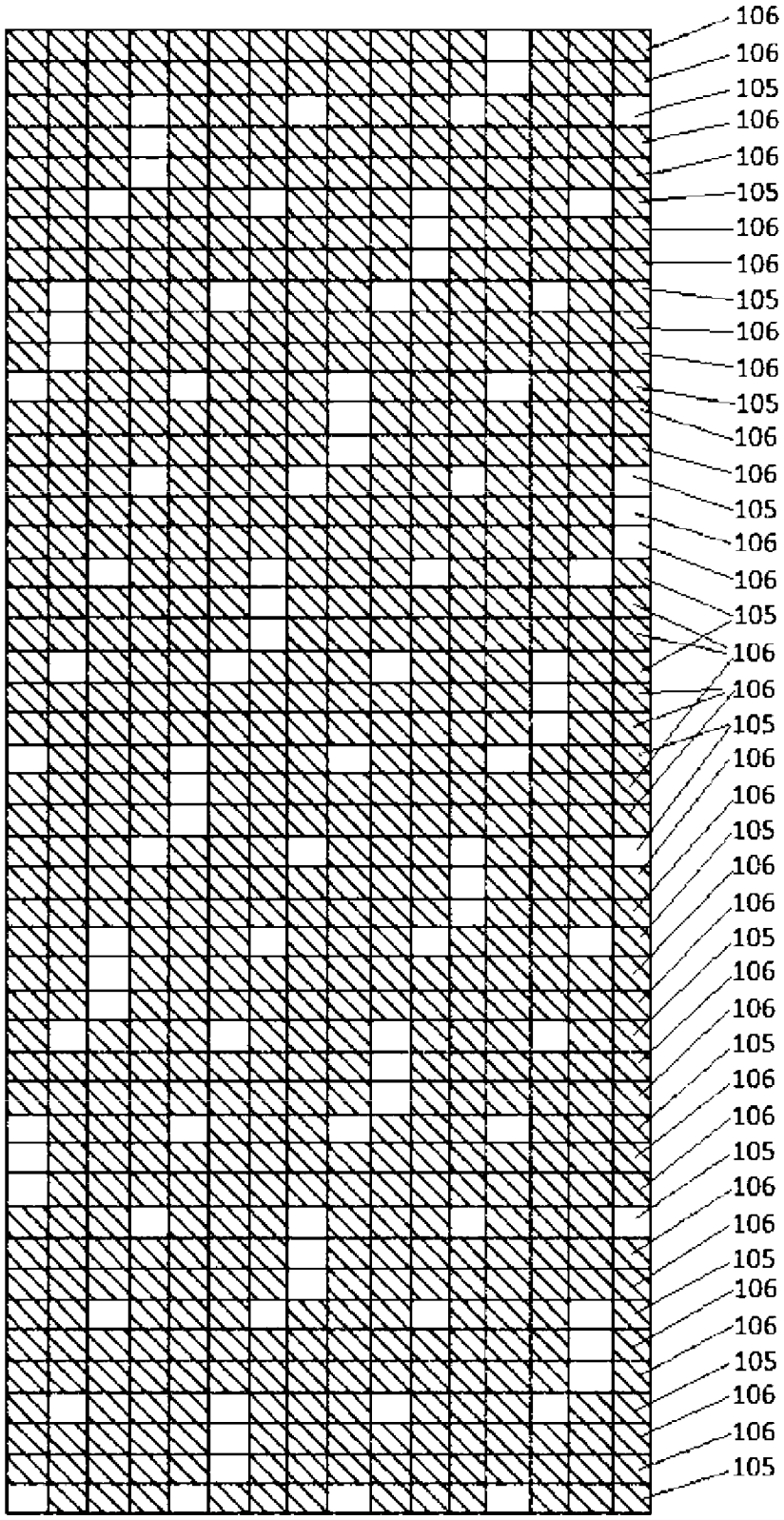
Figure 4:
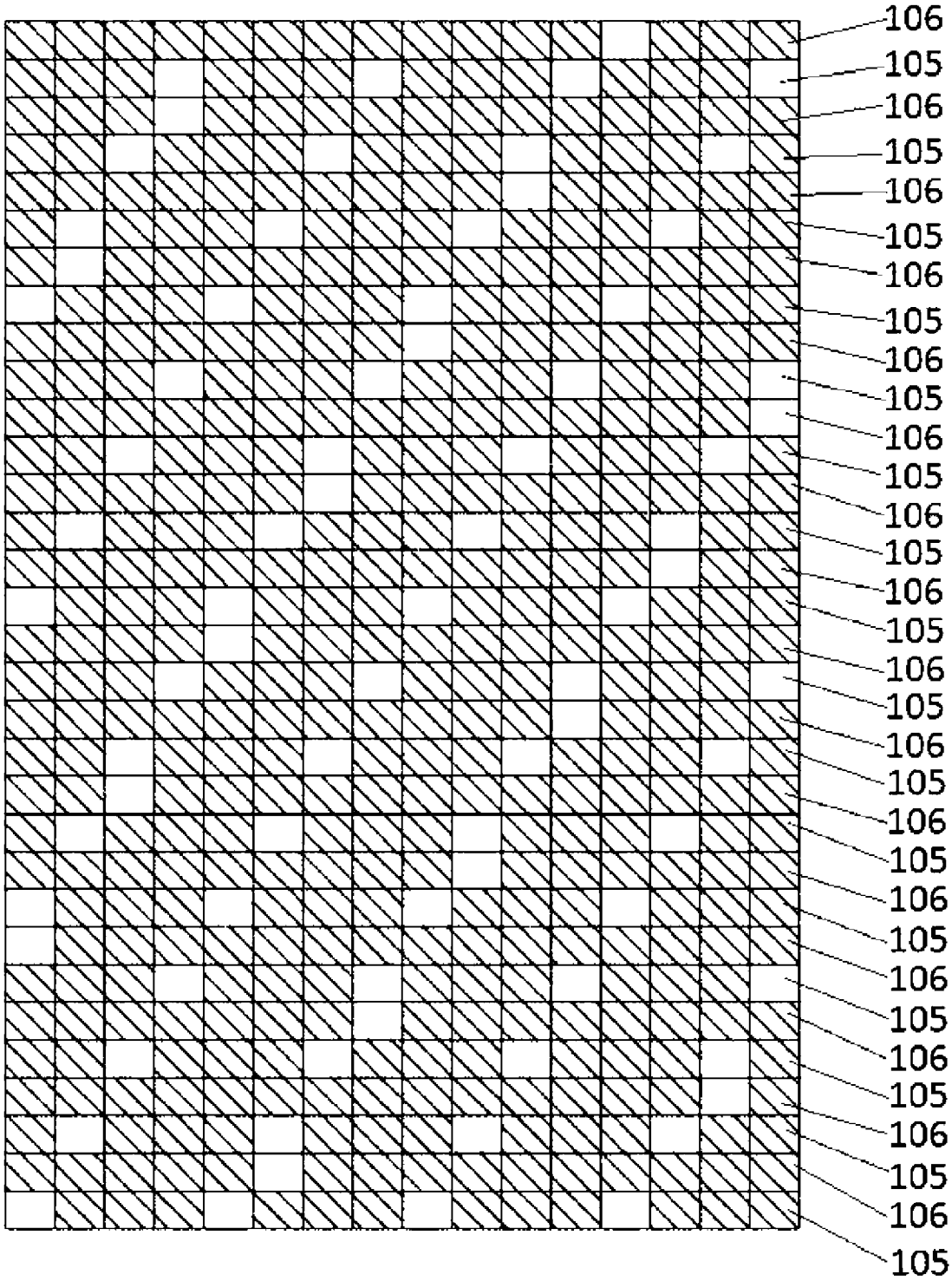
Figure 5:
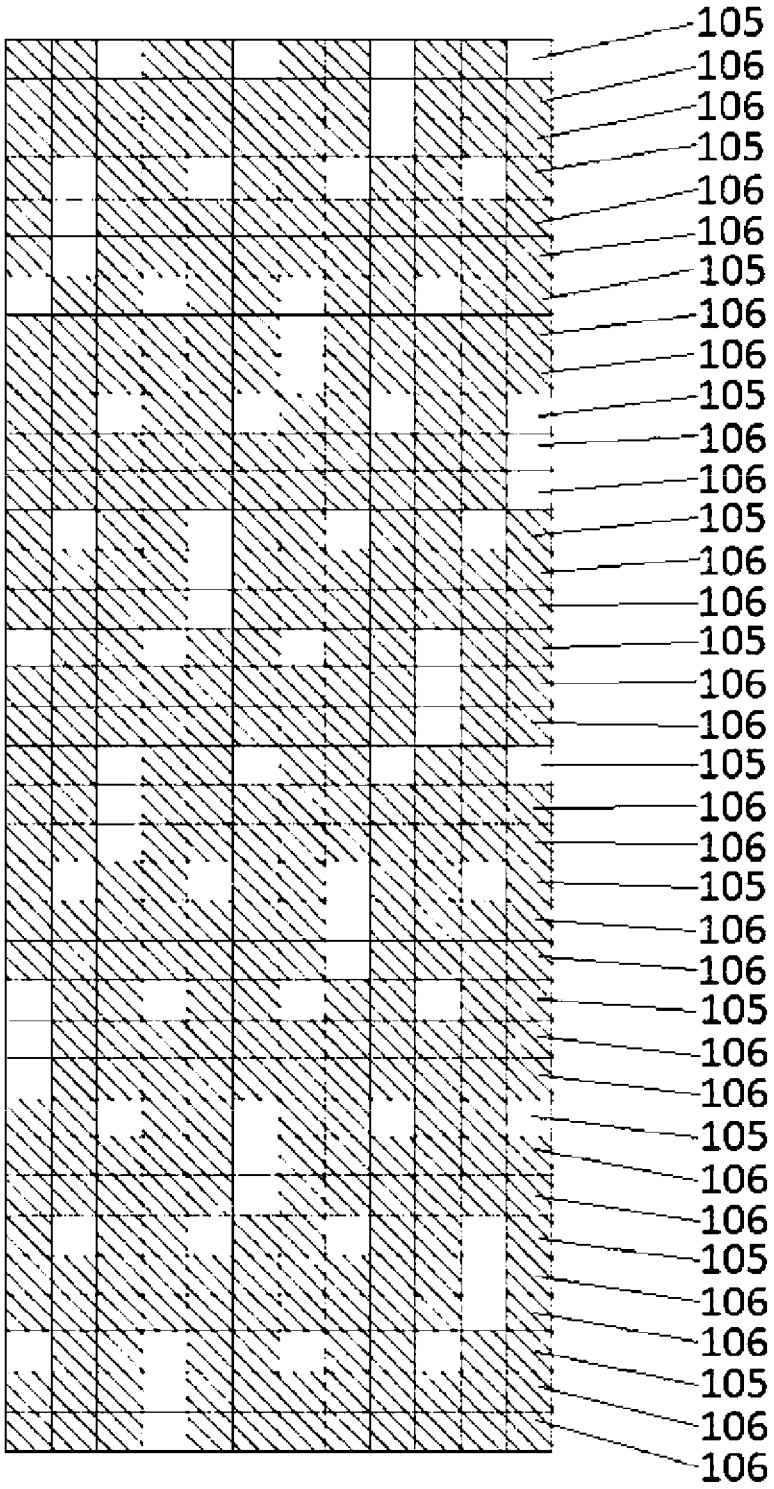

FIG. 1 is the schematic view of the back face of the fabric.
FIG. 2 is the schematic cross-sectional view of the fabric.
FIG. 3 is the illustration of weaving pattern 1.
FIG. 4 is the illustration of weaving pattern 2.
FIG. 5 is the illustration of weaving pattern 3.

DESCRIPTION OF REFERENCE NUMERALS

101. Woven fabric
102. Front face of the fabric
103. Back face of the fabric
104. Warp yarns
105. Auxiliary weft yarn
106. Pile weft yarn
107. Pile base portion
108. Loop connection point
109. The number of bypassed warp yarns with which the pile weft yarn is not connected

DETAILED DESCRIPTION OF THE INVENTION

In order to overcome the drawbacks of the prior art, the invention permits obtaining a woven fabric, according to the determined fabric design, which has a suitable fabric dimensional stability and presents a firm handle and soft touch, using yarns with a high degree of hairiness, but without applying the sueding process.

For describing the embodiment of the invention in a more clear way, the detailed formulas, calculations and the related standards are presented below.

1) Fabric Pattern Design According to the Density Coefficient (K) Value of the Pile Weft Yarn A different fabric pattern has been designed for obtaining a napped and soft surface on the back face (103) of the fabric. It is ensured, with this design, that the pile weft yarns (106) are on the back face (103) of the fabric and the pile weft yarns (106) are higher in density. In order to formulate this, the Pile Weft Yarn Density Coefficient (K) value is calculated. With a fabric pattern design having a high K value, a soft and napped surface is formed on the back face (103) of the fabric. The K value of the woven fabric according to the invention is increased more than 40% when compared to the known denim fabrics, thereby increasing the number of warp yarns (109) with which the pile weft yarn is not connected and which is bypassed. During the trials and tests conducted for reaching the suitable fabric properties, the number of warp yarns (109) with which the pile weft yarn is not connected and which is bypassed was determined to be at least eleven in number. FIG. 3, FIG. 4, and FIG. 5 show the illustrations of weaving patterns of the fabric according to the invention, wherein the K value is aimed to be high as given in the Table 1 below.

The Calculation of Pile Weft Yarn Density Coefficient (K):

Ne: Yarn numbering, English measurement of unit a: Warp yarn diameter is calculated with the formula "=0.908/√NeWarp Yarn".

b: Weft yarn diameter is calculated with the formula "=0.908/√NeWeft Yarn".

c: Weft Yarn density, "number of weft/cm"

d: Warp Yarn density, "number of warp/cm"

The number of bypassed warp yarns with which the pile weft yarn is not connected (FIG. 2)

e: 109 f: Loop Connection Point Number is calculated using the formula "=d/(e+1)".

X: Loop Connection Point Area is calculated using the formula "=a×b×f×c/2".

r Total Pile Weft Yarn Area is calculated using the formula "=b×c×1 cm".

K: Pile Weft Yarn Density Coefficient is calculated using the formula "=(Y−X)/Y".

TABLE 1

| Example | Warp Yarn Number Thickness (Ne) | Warp Yarn Density in Reed (Ends/cm) | Pile Weft Yarn Number Thickness (Ne) | Auxiliary Weft Yarn Number Thickness (Ne) | Weft Yarn Density in Finished Fabric (Wire/cm) | Weaving Pattern Number (FIG.) | Pile Weft Yarn Connection Number (Number/10 cm, in Fabric Width Direction on the Reed) | Recovery Test Value ASTM D3107 | K % |
|---|---|---|---|---|---|---|---|---|---|
| Example 1 | Ne20/1 100% Ring Cotton Yarn | 26 | Ne50/1 Ring Cotton Yarn + Core-spun 44Dtex Elastane | 78Dtex PES filament + 44Dtex Elastane | 67 | Weaving Pattern 1 (FIG. 3) | 15 | 465 | 83.5 |
| Example 2 | Ne20/1 100% Ring Cotton Yarn | 26 | Ne50/1 Ring Cotton Yarn + Core-spun 44Dtex Elastane | 78Dtex PES filament + 44Dtex Elastane | 67 | Weaving Pattern 2 (FIG. 4) | 15 | 312 | 83.5 |
| Example 3 | Ne20/1 100% Ring Cotton Yarn | 26 | Ne50/1 Ring Cotton Yarn + Core-spun 44Dtex Elastane | 78Dtex PES filament + 44Dtex Elastane | 67 | Weaving Pattern 3 (FIG. 5) | 11 | 286 | 78.0 |
| Example 4 | Ne20/1 100% Ring Cotton Yarn | 26 | Ne30/1 Ring Cotton Yarn + Core-spun 44Dtex Elastane | 78Dtex PES filament + 44Dtex Elastane | 56 | Weaving Pattern 2 (FIG. 4) | 15 | 261 | 83.5 |
| Example 5 | Ne14/1 100% Ring Cotton Yarn | 26 | Ne50/1 Ring Cotton Yarn + Core-spun 44Dtex Elastane | 78Dtex PES filament + 44Dtex Elastane | 67 | Weaving Pattern 1 (FIG. 3) | 15 | 414 | 83.5 |

Growth Test was conducted as per ASTM D3107 standards.

2) Fabric Pattern Design According to Growth Test Value

The limit of the minimum number of loop connection points (108) of the pile weft yarns (106) is restricted by the acceptable tolerances of the fabric dimensional stability. The present invention was evaluated as per Growth Test ASTM D3107 Standards, one of the textile test methods measuring dimensional stability of the fabric. Growth is the test which examines the recovery capability of the fabric after tensions are applied thereon during use and after washing. If said value is high, it means that stretching/widening occurs in the knee and elbow areas of the cloth after use. The illustrated fabric designs of the present invention are formed taking the acceptable growth test value range into account, as shown in Table 1.

3) Properties of the Weft Yarns a. Pile Weft Yarn Structure

The pile weft yarns (106) arranged on the back face (103) of the fabric are made of cotton core-spun elastane yarns. As it is aimed to connection the pile weft yarns (106) with minimum number of loop connection points (108), it can move freely on fabric surface. In order to minimize said freedom and allow a more stretched positioning, cotton core-spun yarns are used. Thus, a stretched appearance which covers the surface is obtained in the back face (103) of the fabric.

Core-spun is the name given to the yarn which is made of short staple fibers and has elastane in its center. The elasticity of the woven fabrics produced of core-spun yarns in weft direction is higher than that of the rigid fabrics. In the fabric designs according to the present invention illustrated in FIG. 3, FIG. 4, and FIG. 5, the pile weft yarns (106) are made of cotton core-spun elastane yarns, as shown in Table 1.

b. Pile Weft Yarn Hairiness Value

The pile weft yarns (106) arranged on the back face (103) of the fabric are made of yarns with a high degree of hairiness. Thanks to the use of the yarns having a high degree of hairiness, the fabric is provided with a softer handle, at the same time with a firm effect. The degree of hairiness of the yarn is generally measured using the devices for measuring yarn hairiness value by the firm Uster Technologies Ag, and the experiments given in Table 2 are performed using this device. Of two yarns produced under the same conditions, the one having the lower yarn twist has a higher hairiness index value, and thus having a higher level of hairiness. However, the less the yarn twist, the lower the yarn breaking strength. In the product according to the present invention, the pile weft yarn was determined to have a high hairiness value and a sufficient level of breaking strength. In the fabric designs according to the present invention illustrated in FIG. 3, FIG. 4, and FIG. 5, the pile weft yarns (106) are formed with a targeted hairiness index value of 4-4.5, the results of which are shown in Table 2.

TABLE 2

| Trial | Yarn Number Thickness (Ne) | Twist (Twist/Meter) | Hairiness Value ($H_v$ index) | Breaking Strength (cN) |
|---|---|---|---|---|
| Trial 1 | 50 | 989-Z | 4.1 | 232.3 |
| Trial 2 | 50 | 1111-Z | 3.4 | 289.4 |

The tests were performed using USTER Tensorapid 4 and Tester 4 Devices.

c. Auxiliary Weft Yarn Structure

The weft yarns with elasticity are used for obtaining woven fabrics having elasticity in weft direction. In the woven fabric (101) according to the invention, synthetic yarns with high elasticity are used as auxiliary weft yarns (105) for providing elasticity. The reason for that is both providing elasticity and improving the growth test value. This is because negative results were obtained in terms of growth test values in the fabrics produced with pile weft yarns (106) with minimum loop connection points (108) and designed in a way to be arranged on the back face (103) of the fabric according to the invention. The growth test yielded positive results when elastomeric synthetic weft yarns are used as auxiliary weft yarns (105) in the novel woven fabric (101) design. In the fabric designs according to the present invention illustrated in FIG. 3, FIG. 4 and FIG. 5, the auxiliary weft yarns (105) are made of synthetic yarns, as shown in Table 1.

The yarns at the back face (103) of the fabric are envisaged such that they will form minimum number of loop connection points (108) with this fabric. This is because the yarn with a high degree of hairiness which is to provide the suede-like and napped effect is designed at the back face (103) of the fabric. In order to achieve a suede-like effect, the amount of the pile weft yarns (106) at the back face (103) of the fabric must be high. For the pile weft yarns (106) to be as dense as possible at the back face (103) of the fabric, they must form the minimum number of loop connection points (108) on the fabric.

As a result of the trials and tests, the number of warp yarns (109) with which the pile weft yarn is not connected and which is bypassed was determined to be at least eleven, at most sixteen in number. Once the pile weft yarn (106) passes the warp yarn (104), it is connected with the fabric by means of loop connection point (108).

The illustrated fabric designs according the present invention, depending on the value ranges regarding Warp Ne, Warp density, Weft Ne, Weft density, Fabric Pattern, the Number of bypassed warp yarns with which the Pile Weft Yarn is not connected are defined in claims, and not limited to the above description made only for illustrative purposes.

The invention claimed is:

1. A woven fabric, wherein pile weft yarns, auxiliary weft yarns, and warp yarns are weaved in a front face and a back face of the fabric according to a pattern, and wherein at least one of the pile weft yarns and/or auxiliary weft yarns comprises synthetic elastomeric yarn and at least one of the same comprises cotton core-spun elastomeric yarn, wherein:

the number of bypassed warp yarns with which the pile weft yarn is not connected is at least 11, at most sixteen;

that the pile weft yarn, once it passes the warp yarn, is connected with the fabric by means of loop connection point; and cotton core-spun elastomeric based pile weft yarns that are used in the fabric pattern are positioned at the back face of the fabric under the warp yarns.

2. The woven fabric according to claim 1, characterized in that the degree of hairiness of the pile weft yarns formed of cotton core-spun elastomeric yarns is at least 50% as per Uster Statistics hairiness index value.

3. The woven fabric according to claim 1, characterized in that elastomeric synthetic yarns are used as auxiliary weft yarns.

* * * * *